United States Patent [19]

Yan et al.

[11] Patent Number: 4,511,459

[45] Date of Patent: Apr. 16, 1985

[54] SIMULTANEOUS COKING OF RESIDUAL OIL AND PARTIAL GASIFICATION AND DESULFURIZATION OF COAL

[75] Inventors: Tsoung Y. Yan, Philadelphia, Pa.; Paul Shu, Princeton Junction, N.J.

[73] Assignee: Mobil Oil Corporation, New York, N.Y.

[21] Appl. No.: 512,509

[22] Filed: Jul. 11, 1983

[51] Int. Cl.[3] ..... C10G 9/32

[52] U.S. Cl. ..... 208/127; 208/50; 208/106; 208/129; 208/130; 201/17; 201/23; 201/38; 201/44; 48/197 R; 44/15 R

[58] Field of Search ..... 208/127, 128, 129, 130, 208/50, 136, 8 R, 11 R; 48/197 R; 201/17, 23, 201/38, 44; 44/18 R

[56] References Cited

U.S. PATENT DOCUMENTS

| | | | |
|---|---|---|---|
| 2,698,830 | 1/1955 | Jenny | 208/129 |
| 2,894,899 | 7/1959 | Cranley | 208/127 |
| 3,130,146 | 4/1964 | Plaster | 208/106 |
| 3,702,819 | 11/1972 | Metrailer | 208/127 |
| 3,870,621 | 3/1975 | Arnold et al. | 208/11 R |
| 4,055,484 | 10/1977 | Blaser et al. | 208/127 |
| 4,358,290 | 11/1982 | Chen et al. | 208/127 |

*Primary Examiner*—Delbert E. Gantz
*Assistant Examiner*—Anthony McFarlane
*Attorney, Agent, or Firm*—Alexander J. McKillop; Michael G. Gilman; Charles J. Speciale

[57] ABSTRACT

Coking of residual oil and devolatization/partial gasification and desulfurization of solid particulate fuel are carried out in a single reactor. The particulate fuel is burned in a combustion zone in the bottom of the reactor. A bed of particulate fuel is fluidized above the combustion zone with gases rising from the combustion zone. The fluidized bed is maintained at a temperature which cokes the residual oil and volatizes the particulate fuel. A high temperature, low velocity zone is maintained between the combustion zone and the fluidized bed for calcination and desulfurization of the solid fuel.

11 Claims, 1 Drawing Figure

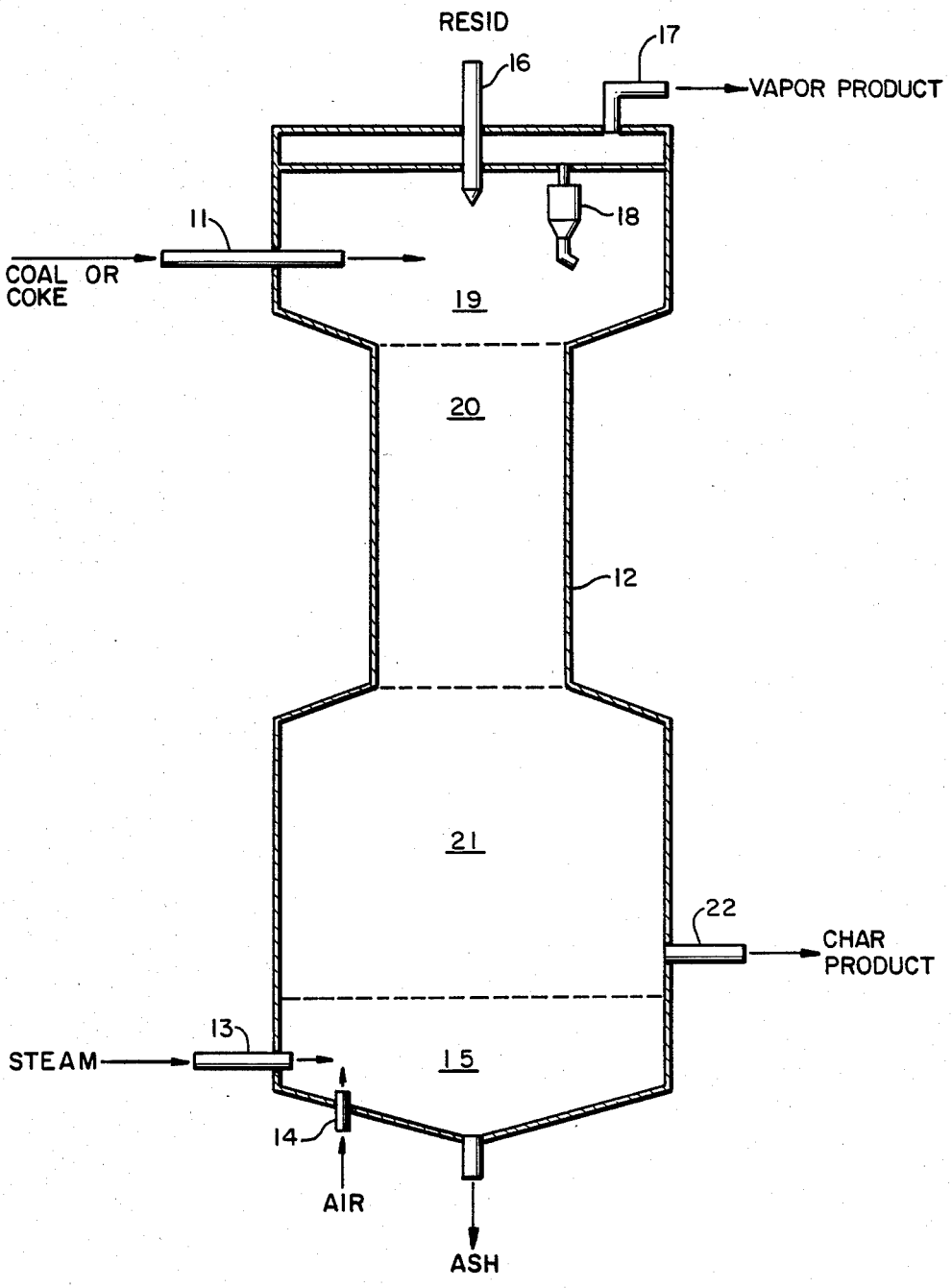
RESID
16
17
VAPOR PRODUCT
18
11
COAL OR
COKE
19
20
12
21
22
CHAR
PRODUCT
13
STEAM
15
14
AIR
ASH

SIMULTANEOUS COKING OF RESIDUAL OIL AND PARTIAL GASIFICATION AND DESULFURIZATION OF COAL

BACKGROUND OF THE INVENTION

This invention relates to the coking of residual oil, and the partial gasification and desulfurization of coal, and more particularly, to performing these operations simultaneously in a single reactor.

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes being present.

The high metals content of the residual fractions generally preclude their effective use as chargestocks for subsequent catalytic processing, such as catalytic cracking and hydrocracking, because the metal contaminants deposit on the special catalysts for these processes and cause the formation of inordinate amounts of coke, dry gas, and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. temperature and a pressure of 1-10 atmospheres. The economic value of the coke byproduct is determined by its quality, particularly its sulfur and metals content. Excessively high levels of these contaminants make the coke useful only as lowvalued fuel. In contrast, cokes of low metals content, for example up to about 100 ppm (parts per million by weight) of nickel and vanadium and containing less than about 2 wt.% sulfur, may be used in high valued metallurgical, electrical, and mechanical applications.

Typical coking processes are shown in "PETROLEUM PROCESSING-PRINCIPLES AND APPLICATIONS", R. J. Hengstbeck, McGraw Hill Book Co., Inc., 1959, p. 138. Delayed coking is a batch process which is expensive to operate because of its high labor intensity. The liquid yield is not as high as it could be due to excessive secondary cracking. Fluid coking is a continuous process. The liquid yield is higher but it produces coke of low value. Transferring coke between the burner and the reactor is expensive.

As petroleum resources become increasingly scarce, conversion of coal into gas and liquid fuels becomes increasingly necessary. Currently many such processes are at various stages of development. Unfortunately, the processes are all expensive, mainly due to their high investment costs. The current challenge in process development is to lower the investment cost.

From coal, substantial amounts of gas and liquid fuels can be obtained by pyrolysis and partial gasification. FIGS. 20.52, 24.14, 24.33, 24.37, 24.38, and 24.39 of "Chemistry of Coal Utilization," National Research Council Committee on Chemical Utilization of Coal, H. H. Lowry, Chairman and Editor, New York, Wiley, 1945 show typical reactors for gasification of coal including the synthane gasifier, the Battelle-Union Carbide gasifier, the British Gas-Lurgi slagging gasifier, the U.S. Bureau of Mines three-stage coal gasifier-combustor, and the West Virginia University pyrolizer/-gasifier.

U.S. Pat. No. 4,317,711-Yan describes a method for co-processing residual oil and coal by visbreaking a slurry of heavy hydrocarbon oil and finally divided coal. The visbroken mixture yields a demetalized liquid hydrocarbon product. "COAL AS LIQUID FUEL EXTENDER FOR PROCESS HEATERS", Ser. No. 346, 436, filed Feb. 8, 1982, Yan, describes a process in which a slurry of coal and residual oil is visbroken to yield liquid product which is suitable for use in process heaters and solid fuel which is suitable for use in solid fuel furnaces.

The use of coal as a refinery fuel is becoming increasingly desirable. However, it is quite difficult to use coal for process heaters. Coal gasification is one way of converting coal to a fuel which can be used in these heaters. However, maintaining a devoted gasifier for the generation of gaseous fuel for refinery use is quite expensive because of its small size and the need for an oxygen plant. The refinery power plant can use solid fuels, but the sulfur content of coal and coke are often too high. Markets exist for low sulfur coke and coal as carbon material for fuel. However, the desulfurization of solid coke or coal is difficult, because it is impractical to calcite these solid fuels to 1800° F. or higher which is required to thermally volatize sulfur compounds.

It is an object of the present invention to upgrade residual oil by coking it while simultaneously devolatizing and partially gasifying coal or coke to produce fuel gas, coal liquid and low sulfur char.

It is another object of the present invention to desulfurize the coal to low sulfur, high heating value solid fuel.

RELATED APPLICATIONS

"CONTINUOUS COKING OF RESIDUAL OIL AND PRODUCTION OF GASEOUS FUEL AND SMOKELESS SOLID FUELS FROM COAL", Ser. No. 512,505, filed 7/11/83, Yan, Whitehurst and Shu, relates to the coking of residual oil and the gasification of coal in a single reactor. The present invention is an improvement on the invention described in that application which is incorporated herein by reference. "PRODUCTION OF LOW METAL COKE FROM HIGH METAL RESIDUA IN REACTOR HAVING FLUIDIZED AND QUIESCENT ZONES", Ser. No. 495,898, filed, 5/18/83 T. Y. Yan describes a process in which the residual oil is coked in the same reactor in which oil and coal are coprocessed by maintaining a fluidized bed of coal and residual oil, and a quiescent zone on top of the fluidized bed, wherein coke settles out and is recycled to the fluidized bed zone.

SUMMARY OF THE INVENTION

In accordance with the present invention, the coking of residual oil and the partial gasification and desulfurization of coal or coke are carried out simultaneously in a single reactor which has a combustion zone for burning the particulate fuel in the bottom thereof. A bed of particulate fuel above the combustion zone is fluidized with gases rising from the combustion zone. The fluidized bed is maintained at a temperature which cokes the residual oil and volatizes the particulate fuel. In accordance with the invention, a high temperature, low velocity, zone between the combustion zone and the fluidized bed is maintained at a temperature sufficiently high for calcination and desulfurization of the solid particulate fuel. Because of the low velocity of the zone, a high temperature differential can be maintained between the bottom of the low velocity zone and the top of the low velocity zone. In this manner the high temperature required for calcination and desulfurization of coal or coke is obtained.

The foregoing and other objects, features and advantages of the invention will be better understood from the following more detailed description and appended claims.

SHORT DESCRIPTION OF THE DRAWING

The single sheet of drawing shows a reactor operated in accordance with the invention.

DESCRIPTION OF THE PREFERRED EMBODIMENT

Coal or other solid carbonaceous material is reduced to a particle size of preferably about 10 to 200 mesh in a pulverizer (not shown) and continuously fed through conduit 11 to a coal distributor in the top of reactor 12. Steam and air (or oxygen) are fed to the reactor via conduits 13 and 14 to the combustion and gasification zone 15. When no partial gasification of the solid carbonaceous material is desired, the quantity of air is controlled so that the combustion generates exactly the heat required in the process. If certain levels of partial gasification of the carbonaceous material is required, additional air and steam corresponding to the stoichemetry and heat requirement are injected. The combustion zone 15 is preferably maintained as high as possible to ensure complete combustion, between 2000°-3000° F. The combustion of coal required to achieve heat balance is typically equivalent to about 2-10% of the residual oil in heat content. In order to achieve substantial desulfurization of the coal, about 10-40% of gasification of coal is required. The temperature is maintained by using super heated steam although heat also can be provided by the addition of the oxygen. The pressure may vary up to about 500 psi, but pressures under 2000 psi are preferred. The amount of steam introduced will generally be in the range of 0.1 to 0.3 lbs. per pound of coal. The steam temperature is conveniently between 800° F. and 1200° F. and the pressure is substantially atmospheric.

Residual oil is supplied through conduit 16 to the top of reactor 12, where it contacts the top of the fluidized zone 20. This feed injection in a form of spray is preferred to ensure uniform distribution across the reactor and maximum contact with the rising vapor and gases.

The gas and liquid products are recovered in the form of vapor from the conduit 17 in the top of the reactor. Cyclone 18 separates vapor from particulate.

The reactor of the present invention is divided into distinct zones. The zone 19 is the gas phase, low velocity zone for the solid particles to contact with residua and to settle. The zone 20 is the fluidized bed zone where residua are coked and the coal is devolatized. The zone 21 is a slow moving bed to maintain a high temperature gradient across this bed. The upper part of the zone 21 is for calcination and desulfurization of coal char and coke. The bottom zone 15 is for combustion and gasification of coal or coke at the highest temperature to assure high carbon utilization efficiency. The coal or coke below the combustion zone is completely consumed. The solid product of devolatization and calcination reactions is a low sulfur char which is withdrawn through conduit 22. The ash may be melted.

The required amount of air and steam is injected to effect gasification. The hot syngas which is essentially free of oxygen moves upward out of combustion zone 15 to calcine the coke or char which is moving down slowly in zone 21. In this zone a great temperature drop occurs. It drops from 2,000°-3,000° F. to 1,000°-1,500° F. This temperature profile is maintained because the solid substrate is slowly moving downward due to continuous withdrawal of char product and there is no convection or fluidizing of the solids. The char or coke is further devolatized to a very low level of volatile matter content, but most importantly the refractory sulfur which is about 40 to 60% of the sulfur in the original coal is thermally decomposed, and removed from the char or coke. Depending on the reactor temperature and the nature of the coal, the degree of desulfurization can be from 20 to 90%, resulting in low sulfur coke or synfuels which could meet the sulfur specifications. The superficial gas velocity in zone 21 is between 0.05-0.5 ft/sec. to assure proper flow pattern, and the residence time of coke or char is between 0.1 to 5 hours to assure completion of calcination and desulfurization.

The gas stream is further moved up through the fluidizing zone 20. In this zone, coking of residua and devolatization of coal or coke takes place. The gas velocity is controlled at 0.2 to 2 ft/sec. the ensure good fluidization so that the solids will not cake and agglomerate. Because of the good mixing in this fluidized zone, the reactor temperature is uniform and should be controlled at 850°-1200° F. to obtain the best results. High yield of low metal liquid product better than delayed coking and, comparable to that of fluid coking is obtained from residua. Additional liquid derived from the devolatization of coal further increase the liquid yield. The temperature is controlled by the quantity of air and steam injected at the bottom of the reactor. To complete the reactions, the residence time of solids, coal and/or coke in this zone is 0.05 to 2 hrs.

The gas and vapor product move upward to the settling zone 19 to settle the entrained solid particles. In this zone, the residua is also partially vaporized and coal is also partially devolatized.

Effective thermal desulfurization of solid fuel requires temperatures in excess of 1800° F. or 2000° F. As a result, thermal desulfurization of solid was never economical when the desulfurization was the sole purpose. The high cost of a high temperature calciner makes such a process unattractive. In accordance with the present invention, thermal desulfurization has been combined with residual oil coking and coal gasification in a multipurpose unit of low cost design.

Liquid carbonaceous materials other than residual oil can be used. The preferred liquid feeds would have a Conradson carbon content of 5 wt.% or higher. Suitable liquid carbonaceous materials for use in the present invention include heavy hydrocarbon oils, heavy and reduced petroleum crudes, atmospheric residua, pitch, asphalt, tar sand oil, bitumen, other heavy hydrocarbon residues and liquid products derived from extraneous coal liquification processes.

A variety of different coals can be used. For high yield of liquid and gas, coal of high volatility is preferred. In order to produce high quality smokeless fuel, low sulfur and low ash coal is preferred, though 50-80% of the sulfur in the coal is easily removed by this process. Rapid pyrolysis in the process produces char of high surface areas and excellent combustion characteristics which is distinctly different from the conventional fluid coke. In addition to all ranks of coal, other solid carbonaceous material can be used; these materials includes biomass, wood, cellulose, paper, tires, waste plastics.

The vaporous products include gaseous hydrocarbons and normally liquid hydrocarbons as well as other gases which were introduced into the reactor as fluidizing gas. The vapor phase product is removed from the reactor by conduit 17 for scrubbing and fractionation in a conventional way. Gas product high in heating value can be used as process heater fuel directly. If it is desired, a portion of the vaporized effluent can be recycled to the coker as fluidizing gas. The fractionator tower bottom may be recycled to the reactor or the reactor may be operated in a once-through manner, that is, without recycle of the heavy material to the reactor.

Separate feeding of coal and residual oil, as described above, are preferred. However, coal and residual oil may be combined in a form of a slurry, if desired.

Reactors of the type previously described may be modified for use in carrying out the process of this invention.

While a particular embodiment of the invention has been shown and described, various modifications are within the true spirit and scope of the invention. The appended claims are, therefore, intended to cover all such modifications.

What is claimed is:

1. A process for the coking of residual oil and the devolatization/partial gasification and desulfurization of solid particulate fuel comprising:

feeding particulate fuel to the top of a reactor;

supplying residual oil to the top of said reactor;

burning said particulate fuel in a combustion zone in the bottom of said reactor;

withdrawing char from the bottom of said reactor;

fluidizing a bed of particulate fuel above said combustion zone with gases rising from said combustion zone;

maintaining the fluidized bed at a temperature which cokes said residual oil and devolatizes said particulate fuel; and maintaining a high temperature, low velocity zone between said combustion zone and said fluidized bed, said particulate fuel being moved downwardly through said low velocity zone due to said withdrawal of char, said gases being moved upwardly through said low velocity zone at velocities between 0.05–0.5 ft/sec, with no convection or fluidizing of the solids in said low velocity zone so that said low velocity zone is maintained at a temperature sufficiently high for calcination and desulfurization of said solid particulate fuel, and said fluidized bed is maintained at said temperature which cokes residual oil, with a high temperature gradient across said low velocity zone.

2. The process recited in claim 1 further comprising:

supplying air to said combustion zone.

3. The process recited in claim 1 further comprising:

supplying steam to said combustion zone to effect gasification of said particulate fuel.

4. The process recited in claim 1 further comprising:

maintaining a high temperature drop between the bottom of said low velocity zone and the top of said low velocity zone.

5. The process recited in claim 3 wherein said temperature drop is from 2000°–3000° F. at the bottom of said low velocity zone to 1000°–1500° F. at the top of said low velocity zone.

6. The process recited in claim 1 wherein the residence time of solid particulate fuel in said low velocity zone is between 0.1 and 5 hours.

7. The process recited in claim 1 wherein the gas velocity in said fluidized bed zone is between 0.2 and 2 ft./sec.

8. The process recited in claim 1 further comprising:

maintaining the temperature in said fluidized bed zone at 850°–1200° F.

9. The process recited in claim 1 wherein the residence time of particulate solid fuels in said fluidized zone is from 0.05–2 hours.

10. The process recited in claim 1 further comprising:

recovering gaseous fuel and liquid hydrocarbon product from the top of said reactor.

11. A process for the coking of residual oil and the devolatization/partial gasification and desulfurization of solid particulate fuel comprising:

burning said particulate fuel in a combustion zone in the bottom of a reactor;

supplying steam to said combustion zone to effect gasification of said particulate fuel;

withdrawing char from the bottom of said reactor;

fluidizing a bed of particulate fuel above said combustion zone with gases rising from said combustion zone;

maintaining the fluidized bed at a temperature which cokes said residual oil and devolatizes said particulate fuel; and maintaining a high temperature, low velocity zone between said combustion zone and said fluidized bed, said particulate fuel being moved downwardly through said low velocity zone due to said withdrawal of char, said gases being moved upwardly through said low velocity zone at velocities between about 0.05–0.5 ft/sec, bed with no convection or fluidizing of the solids in said low velocity zone so that said low velocity zone is maintained at a temperature sufficiently high for calcination and desulfurization of said solid particulate fuel;

maintaining a settling zone in said reactor on top of said fluidized bed;

supplying particulate fuel to said settling zone; and injecting residual oil into said settling zone, said particulate fuel contacting said residual oil and settling into said fluidized bed.

* * * * *